US006030178A

United States Patent [19]

Caruso

[11] Patent Number: 6,030,178

[45] Date of Patent: Feb. 29, 2000

[54] AXIAL ENTRY DOVETAIL SEGMENT FOR SECURING A CLOSURE BUCKET TO A TURBINE WHEEL AND METHODS OF INSTALLATION

[75] Inventor: David Alan Caruso, Ballston Lake, N.Y.

[73] Assignee: General Electric Co., Schenectady, N.Y.

[21] Appl. No.: 09/152,267

[22] Filed: Sep. 14, 1998

[51] Int. Cl.[7] ..... B63H 1/26

[52] U.S. Cl. ..... 416/220 R; 416/204 A; 416/248; 416/191; 416/193 A

[58] Field of Search ..... 416/220 R, 204 A, 416/248, 191, 193 A; 29/889.21

[56] References Cited

U.S. PATENT DOCUMENTS

| | | | |
|---|---|---|---|
| 3,627,448 | 12/1971 | Rupp et al. | 416/220 R |
| 4,904,160 | 2/1990 | Partington | 416/193 A |
| 5,509,784 | 4/1996 | Caruso et al. | 416/222 |

*Primary Examiner*—Edward K. Look
*Assistant Examiner*—Ninh Nguyen
*Attorney, Agent, or Firm*—Nixon & Vanderhye

[57] ABSTRACT

In a turbine having a rotor wheel with axially extending female dovetails spaced circumferentially one from the other about the circumference of the wheel, buckets having male dovetails at their radially inner ends are axially inserted relative to the rotor wheel to secure the buckets to the wheel. Where the buckets have shrouds at their radial outer ends prohibiting axial entry and assembly of the final or closure bucket onto the wheel, an axial entry dovetail segment having radially opposite male dovetails is employed to secure the final or closure bucket to the wheel. The final bucket includes a female dovetail at its radial inner end while the axial entry dovetail segment has radial inner and outer male dovetails. By radially inserting the final bucket between adjacent buckets nesting its cover with the covers of adjacent blade covers, axial insertion of the segment with the male dovetails engaging the female dovetails of the final bucket and rotor wheel finally secures the final bucket to the rotor wheel.

8 Claims, 2 Drawing Sheets

18b
18a
18y
18x
18
16y
16a
16x
16b
16
20
12
12
12b
14b
14a
12a
12y
14x
12x
14
10

AXIAL ENTRY DOVETAIL SEGMENT FOR SECURING A CLOSURE BUCKET TO A TURBINE WHEEL AND METHODS OF INSTALLATION

TECHNICAL FIELD

The present invention relates to axial entry dovetail attachments between buckets and the wheel of a turbine rotor and particularly relates to an axially inserted dovetail segment for securing the final or closure bucket of a series of axially inserted buckets on a turbine rotor wheel.

BACKGROUND OF THE INVENTION

Axial entry buckets, i.e., rotor blades, are assembled onto a turbine wheel by sliding the buckets along the rotor axis into mating dovetails on the turbine wheels. In prior assemblies, the turbine buckets have male radially inwardly projecting dovetails for mating engagement with radially inwardly directed female dovetails on the turbine wheel. The wheel dovetails are circumferentially spaced from one another about the wheel. Axial entry buckets on turbine wheels have proven quite satisfactory in assembly and use.

Certain turbine designs, however, require integral covers or shrouds at the bucket tips. Typically the shrouds have overlapping protrusions that nest with shrouds of adjacent buckets. For example, certain shrouds may have a generally Z-shaped configuration when viewed in a radially inward direction. Should the buckets be assembled serially around the wheel using the axial entry dovetail system, the protrusions of adjacent shrouds, typically the first assembled and next to the last assembled buckets, prevent assembly of the last axial entry bucket from either the upstream or downstream sides of the wheel. The blocking shroud protrusions cannot be removed because the shrouds must be in contact with one another to maintain continuous circumferential coupling of the buckets at their tips in use. Consequently, securing the final or closure bucket with its shroud to the otherwise completed wheel assembly by the axial entry assembly method presents a problem.

BRIEF SUMMARY OF THE INVENTION

In accordance with the present invention, there is provided an axial entry dovetail segment which facilitates securement of the final or closure bucket to the rotor wheel after all of the buckets except the final closure bucket have been secured to the rotor wheel by the axial entry method. The present invention is particularly useful to secure the final bucket to the rotor wheel in an axial entry system wherein the shrouds on the bucket tips preclude axial entry and securement of the final bucket. To accomplish the foregoing, there is provided an axial entry dovetail segment having generally radially opposite male dovetails extending generally in the axial direction. The rotor wheel is provided with conventional female dovetails at circumferentially spaced positions about the wheel including at a circumferential position which receives the final bucket. The final bucket, however, instead of having a male projecting dovetail for complementary engagement with the female dovetail in the rotor wheel at the final bucket location about the wheel is provided with a female dovetail. The radially inner male dovetail on the dovetail segment is identical to the geometry of the male dovetails on the buckets with the exception of the final bucket. The opposite or radially outer male dovetail of the segment has a configuration generally complementary to the female dovetail of the final bucket.

To assemble the buckets to the rotor wheel, the buckets with the conventional male dovetails are inserted in an axial direction into the female dovetails of the rotor wheel. This is accomplished serially about the rotor wheel. When all of the buckets have been secured to the rotor wheel except for the last bucket, this final bucket may now be inserted between adjacent buckets in a radial direction and positioned essentially between the first bucket assembled and the next to the last bucket assembled onto the wheel. Once the final bucket has been properly located, the axial entry dovetail segment is inserted axially to engage the female dovetails of the final bucket and the rotor wheel, respectively. By enabling the radial insertion of the final bucket, the shroud on the final bucket is able to nest in a radial direction with the covers of the adjacent buckets to form a continuous circumferential coupling of the covers maintaining the integrity of the integral cover design.

In a preferred embodiment according to the present invention, there is provided in a turbine having a rotor wheel with at least one axial entry female wheel dovetail and a bucket having a female bucket dovetail adjacent a radial inner end thereof, an axial entry dovetail segment for securing the bucket to the one wheel dovetail, comprising a segment body extending in a generally axial direction and having generally radially opposite male dovetails extending generally in the axial direction for respective axial reception in the bucket dovetail and the wheel dovetail.

In a further preferred embodiment according to the present invention, there is provided in a turbine having a rotor wheel with axial entry female wheel dovetails spaced one from the other circumferentially about the rotor wheel and a plurality of buckets for the wheel at each circumferential location of the wheel dovetails, a method of installing one of the buckets onto the wheel comprising the steps of providing a female dovetail on a radial inner end of the one bucket and inserting in an axial direction and into the bucket dovetail and one of the wheel dovetails a segment having generally radially opposite male dovetails to secure the one bucket and wheel to one another.

In a still further preferred embodiment according to the present invention, there is provided in a turbine having a rotor wheel with axial entry female wheel dovetails spaced from one another circumferentially about the rotor wheel and a predetermined number of buckets for securement to the wheel, a method of installing the buckets comprising the steps of inserting male dovetails provided on a plurality of buckets, at least one less in number than the predetermined number of buckets, in an axial direction into a corresponding number of female wheel dovetails to secure the plurality of buckets to the wheel and inserting generally radially opposite male dovetails on a dovetail segment into a female dovetail on the wheel and a female dovetail on the one bucket respectively to secure the one bucket to the wheel.

Accordingly, it is a primary object of the present invention to provide a bucket to wheel dovetail design for integral shroud covered buckets using axial entry dovetails such that the integrity of the shrouds can be preserved while simultaneously affording radially assembly of the final bucket with its cover completing the circumferentially extending covers about the rotor wheel.

DETAILED DESCRIPTION OF THE INVENTION

Figure 1:
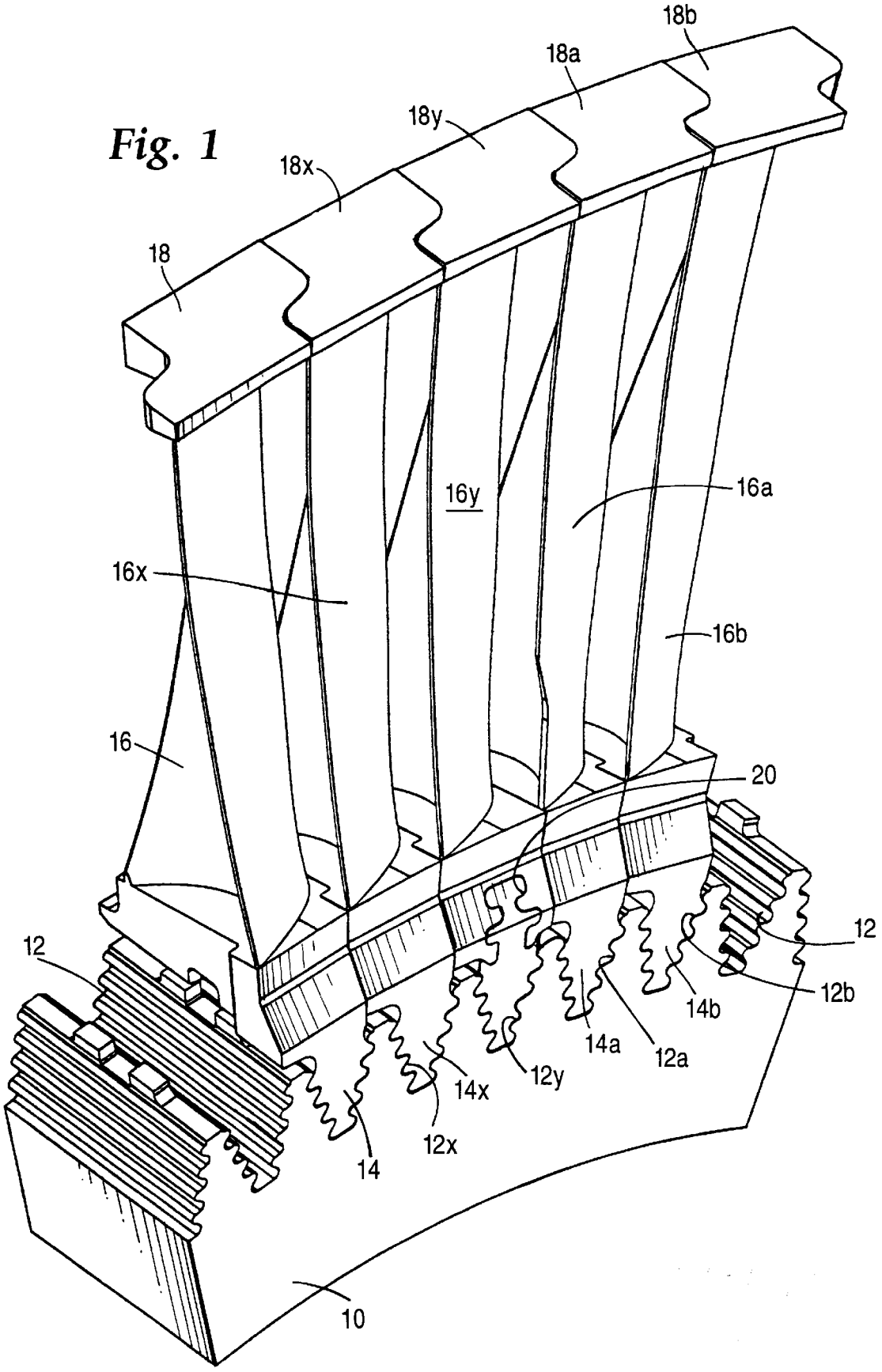
FIG. 1 is a fragmentary perspective view illustrating the connections between the buckets and a rotor wheel as well as the axial entry dovetail segment of the present invention used to secure the final bucket.

Referring now to the drawings, particularly to FIG. 1, there is illustrated a portion of a rotor wheel 10 and which rotor wheel 10 forms part of a turbine. Rotor wheel 10 is rotatable about an axis and has a series of female dovetails 12 spaced circumferentially one from the other about the periphery of the wheel. The female dovetails 12 extend axially, i.e., parallel to the axis of the rotor wheel and receive mating male dovetails 14 formed on the inner ends of buckets 16. The buckets 16 constitute a series of blades or vanes which are acted upon by the hot gases in the flowpath of the turbine to rotate the rotor wheel. The radial inner ends of the buckets 16 are each provided with the male dovetails 14 which enable axial entry of the buckets to the female dovetails upon assembly of the buckets onto the rotor wheel.

Buckets 16 also include shrouds or covers 18 at their radially outer ends which in final assembly contact one another maintaining a continuous circumferential shroud assembly about the bucket tips. Covers 18 of course rotate with the buckets 16 and rotor wheel 10. The covers 18 as illustrated have a generally Z-shaped configuration as viewed in a radial direction and thus interlock or nest with adjacent covers. While the Z-shaped cover configuration is preferred, there are configurations of covers other than Z-shaped. For example, the covers may have linear angled edges. The particular configuration of the covers is dictated to large extent by the twist and curvature of the buckets 16 which circumferentially offsets the leading and trailing edges of the bucket.

As indicated previously, the male dovetails 14 of the buckets 16 are inserted axially into the female dovetails 12 during assembly of the buckets to the rotor wheel. Thus, buckets 16 are assembled serially around the wheel. For example, a first bucket 16*a* is assembled to the rotor wheel 10 by axially displacing the male dovetail 14*a* into the female dovetail 12*a*. The next bucket 16*b* is similarly assembled to the rotor wheel 10 by axially displacing the male dovetail 14*b* into the female dovetail 12*b* of the rotor wheel. It will be appreciated that the covers 18*a* and 18*b* on the bucket 16*a* and 16*b* respectively nest with one another upon such axial entry. Additional buckets are secured to the rotor wheel in like fashion serially about wheel 10 and eventually the next to the last bucket 16*x* is installed on the rotor wheel 10 by inserting the male dovetail 14*x* into the female dovetail 12*x*. Thus it will be appreciated that the buckets, save for one final bucket, are axially inserted into and completely installed about the rotor wheel with the covers 18 in nesting relation relative to one another. However, from a review of FIG. 1 it will be appreciated that the final or closure bucket 16*y* cannot be inserted relative to the rotor wheel from either axial direction because the cover 18*y* cannot pass through the openings defined by the adjacent covers 18*a* and 18*x*. Consequently, a different type of connection and assembly procedure is required to install the final bucket 16*y* onto the rotor wheel 10.

Figure 2:
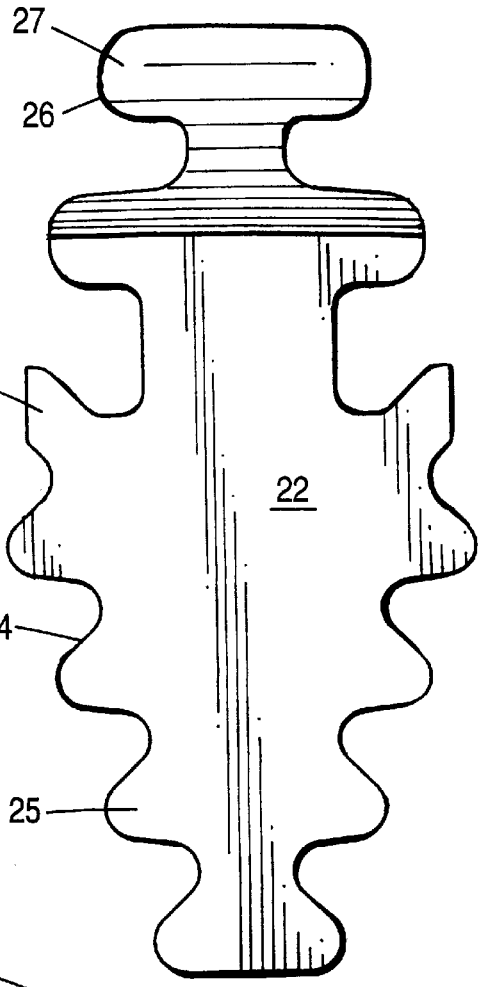
FIG. 2 is a perspective view of the axial entry dovetail segment.
Figure 3:
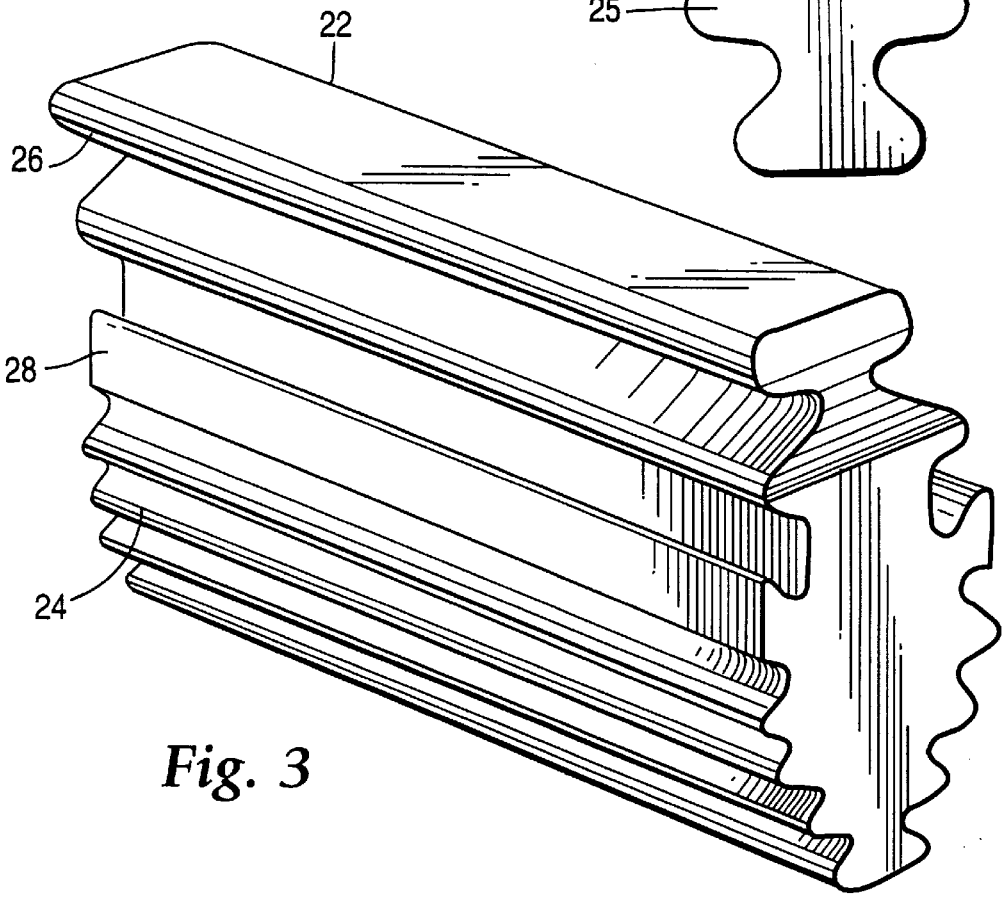
FIG. 3 is an end elevational view thereof.

To accomplish this, instead of providing the final bucket 16*y* with a male dovetail similar to the male dovetails 14 at radial inner ends of the other buckets 16, the final bucket 16*y* is provided with an axially extending female dovetail 20 along its radial inner end. Additionally, as best illustrated in FIG. 2, an axial entry dovetail segment 22 is provided for joining the final bucket 16*y* to the rotor wheel 10 at the female dovetail connection 12*y*. It will be appreciated that the dovetail connection 12*y* is identical to the dovetail connections 14 spaced circumferentially about the rotor wheel 10. The axial entry dovetail segment 22 includes male projecting dovetails 24 and 26 along radially opposite sides of the segment, the segment extending axially a distance corresponding to the axial length of the male dovetails on the buckets 16. The radial innermost male dovetail 24 on segment 22 has a generally complementary shape to the female dovetail 14*y*; whereas the radially outer male dovetail 26 on segment 22 is generally complementary in shape to the female dovetail 20 of the final bucket 16*y*. By employing the axial entry dovetail segment 22 the final bucket 16*y* can be assembled from a radial direction and positioned between the first bucket 16*a* assembled to rotor wheel 10 and the next to the last bucket 16*x* assembled to rotor wheel 10. It will be appreciated that by radially inserting the bucket 16*y*, the radially inner base of the bucket is readily disposed between the radial inner bases of the adjacent buckets 16*a* and 16*x*. Additionally the cover 18*y* of final bucket 16*y* nests between the covers 18*a* and 18*x* of the adjacent buckets. To secure the final or closure bucket 16*y* to the rotor wheel 10, the axial entry dovetail segment 22 is driven axially such that the male dovetails of the segment respectively engage in the female dovetails of the final bucket 16*y* and the rotor wheel 10.

Referring to FIG. 2, the geometry of the radially inner male dovetail 24 of the segment 22 is the same as the female dovetails 12 on the rotor wheel. That is, the hooks 25 of the dovetails are substantially complementary to one another. Similarly, the radially outer male dovetail 26 of segment 22 is complementary in shape to the female dovetail on the final or closure buckets 16*y*. That is, the hooks 27 of the male dovetail are substantially complementary to the hooks of the female dovetail. Note also that the protrusions or tangs 28 on the segment 22. These tangs 28 provide tangential restraint in the mating final or closure bucket female dovetail. Hooks 25 and 27, of course,.engage corresponding hooks in the wheel dovetail and the final bucket female dovetail in final assembly.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a turbine having a rotor wheel with at least one axial entry female wheel dovetail and a bucket having a female bucket dovetail adjacent a radial inner end thereof, an axial entry dovetail segment for securing said bucket to said one wheel dovetail comprising:

a segment body extending in a generally axial direction and having generally radially opposite male dovetails extending generally in said axial direction for respective axial reception in said bucket dovetail and said wheel dovetail.

2. A turbine according to claim 1, wherein each of said radially opposite male dovetails includes at least two hooks projecting to each side of said segment.

3. A turbine according to claim 1 including a plurality of axial entry female wheel dovetails spaced circumferentially about said wheel and a plurality of buckets having generally complementary male bucket dovetails for axial reception in the plurality of female wheel dovetails.

4. A turbine according to claim 3 wherein each of said buckets has a shroud with overlapping protrusions for nesting in a circumferential direction with adjacent shrouds.

5. In a turbine having a rotor wheel with axial entry female wheel dovetails spaced one from the other circumferentially about the rotor wheel and a plurality of buckets for said wheel at each circumferential location of said wheel dovetails, a method of installing one of said buckets onto the wheel comprising the steps of:

providing a female dovetail on a radial inner end of said one bucket; and inserting in an axial direction and into said bucket dovetail and one of said wheel dovetails a segment having generally radially opposite male dovetails to secure the one bucket and wheel to one another.

6. In a turbine having a rotor wheel with axial entry female wheel dovetails spaced from one another circumferentially about the rotor wheel and a predetermined number of buckets for securement to the wheel, a method of installing the buckets comprising the steps of:

inserting male dovetails provided on a plurality of buckets, at least one less in number than said predetermined number of buckets, in an axial direction into a corresponding number of female wheel dovetails to secure said plurality of buckets to said wheel; and inserting generally radially opposite male dovetails on a dovetail segment into a female dovetail on said wheel and a female dovetail on said one bucket respectively to secure said one bucket to said wheel.

7. A method according to claim 6, including inserting said one bucket in a generally radial direction between adjacent buckets prior to inserting said segment.

8. A method according to claim 6, wherein said buckets have covers adjacent radial outer ends thereof and including inserting said plurality of buckets axially onto said wheel to nest the covers with one another and inserting said one bucket radially between adjacent buckets to nest the cover of said one bucket with the covers of said adjacent segments.

* * * * *